US005127557A

United States Patent [19]

Brückner

[11] Patent Number: 5,127,557

[45] Date of Patent: Jul. 7, 1992

[54] SHUT-OFF AND CONTROL VALVE FOR USE IN CONTINUOUS CASTING OF A THIN STRIP OR SLAB

[75] Inventor: Raimund Brückner, Engenhahn, Fed. Rep. of Germany

[73] Assignee: Didier-Werke AG, Wiesbaden, Fed. Rep. of Germany

[21] Appl. No.: 707,313

[22] Filed: May 29, 1991

Related U.S. Application Data

[63] Continuation of Ser. No. 310,672, Feb. 14, 1989, abandoned.

[30] Foreign Application Priority Data

Feb. 18, 1988 [DE] Fed. Rep. of Germany ..... 3805071

[51] Int. Cl.[5] ..... B22D 41/08

[52] U.S. Cl. ..... 222/599; 222/598; 222/591

[58] Field of Search ..... 222/590, 591, 597, 598, 222/599; 266/236

[56] References Cited

U.S. PATENT DOCUMENTS

| | | | |
|---|---|---|---|
| 1,742,065 | 12/1929 | Eiser | 222/598 |
| 3,344,965 | 10/1967 | Kerin | 222/599 |
| 3,651,998 | 3/1972 | Rocher | 222/598 |
| 4,200,210 | 4/1980 | Riegler et al. | 222/598 |
| 4,453,654 | 6/1984 | Bedell | 222/594 |
| 4,913,324 | 4/1990 | Lührsen et al. | 222/598 |

FOREIGN PATENT DOCUMENTS

| | | | |
|---|---|---|---|
| 165292 | 2/1950 | Austria . | |
| 357283 | 9/1977 | Austria . | |
| 0196847 | 10/1986 | European Pat. Off. . | |
| 233481 | 8/1987 | European Pat. Off. . | |
| 0302215 | 2/1989 | European Pat. Off. | 222/599 |
| 357912 | 9/1922 | Fed. Rep. of Germany . | |
| 1916234 | 10/1969 | Fed. Rep. of Germany . | |
| 2203987 | 8/1973 | Fed. Rep. of Germany . | |
| 2608472 | 9/1977 | Fed. Rep. of Germany . | |
| 3306670 | 9/1984 | Fed. Rep. of Germany . | |
| 3342836 | 1/1985 | Fed. Rep. of Germany . | |
| 3508218 | 9/1986 | Fed. Rep. of Germany . | |
| 1072995 | 2/1984 | U.S.S.R. | 222/599 |
| 183241 | 7/1922 | United Kingdom . | |
| 1177262 | 1/1970 | United Kingdom . | |
| 2174029 | 10/1986 | United Kingdom . | |

OTHER PUBLICATIONS

Fachberichte Hüttenpraxis Metallweiterverarbeitung, vol. 24, No. 8/ Dec. 1986, p. 709, "Trials Success for Rotary Valve".

*Primary Examiner*—Scott Kastler

*Attorney, Agent, or Firm*—Wenderoth, Lind & Ponack

[57] ABSTRACT

A shut-off and control valve is used in regulating the discharge of molten metal from a metallurgical vessel into a continuous casting plant for continuous casting of a sheet, strip or slab having a relatively wide width dimension with respect to thickness dimension. The valve includes an elongated refractory stator having therein an elongated recess defined by a cylindrical inner surface. The stator has therethrough an elongated slot-like discharge channel, and the stator is mounted adjacent an elongated outlet opening of a metallurgical vessel. An elongated refractory rotor is rotated about a longitudinal axis and has a cylindrical peripheral outer surface arranged symmetrically about such axis and complementary to the inner surface of the stator. The rotor has therethrough an elongated slot-like flow channel. The rotor is fitted within the recess in the stator with the outer and inner surfaces of the rotor and stator, respectively, symmetrically positioned about the axis and in sealing contact with each other. Rotation of the rotor about the axis relative to the stator and/or axial movement of the rotor within the recess relative to the stator selectively bring the flow channel of the rotor relatively into and out of alignment with the discharge channel of the stator.

30 Claims, 2 Drawing Sheets

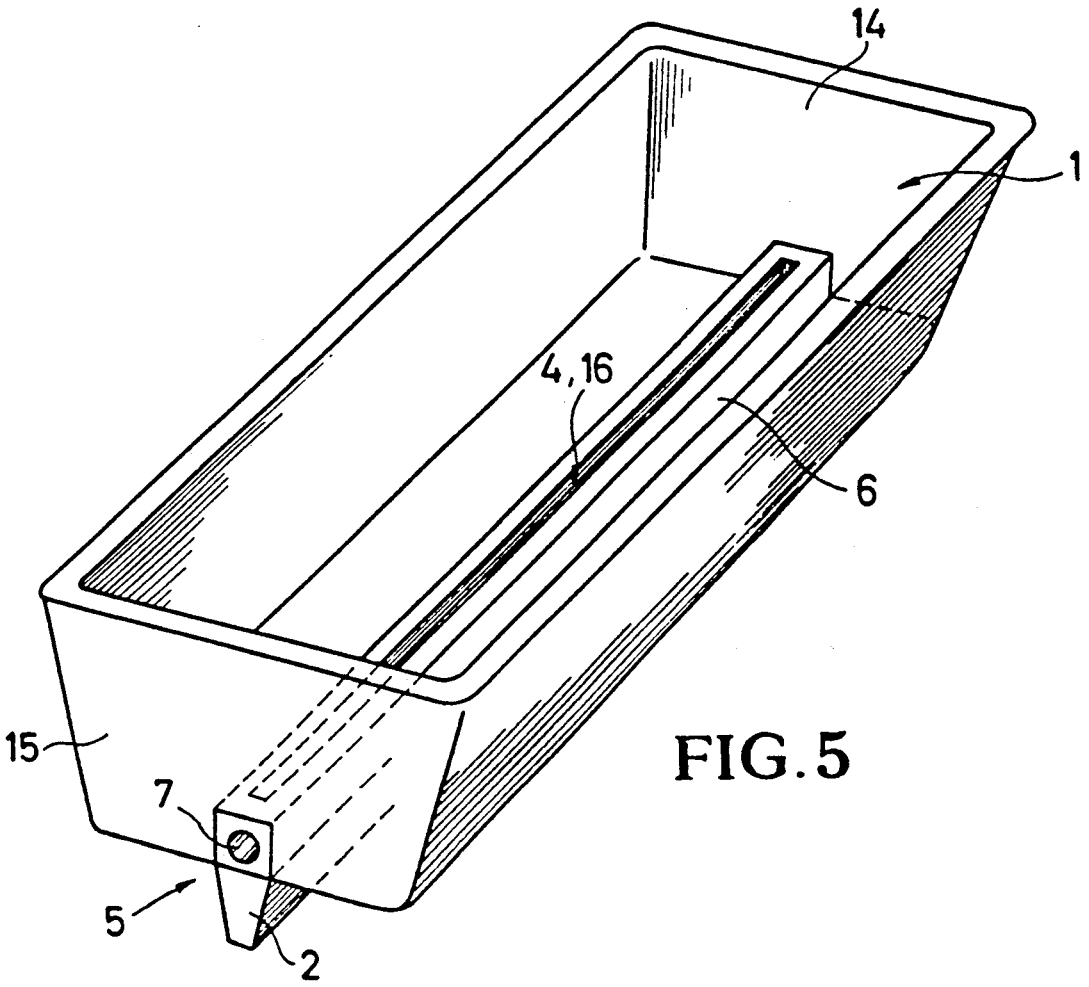
FIG.5
FIG.6a
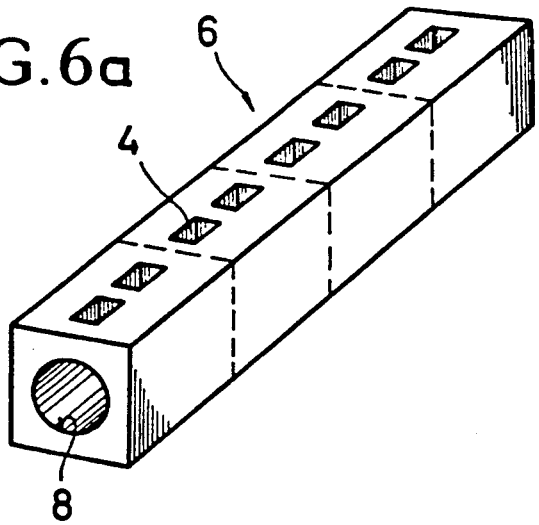
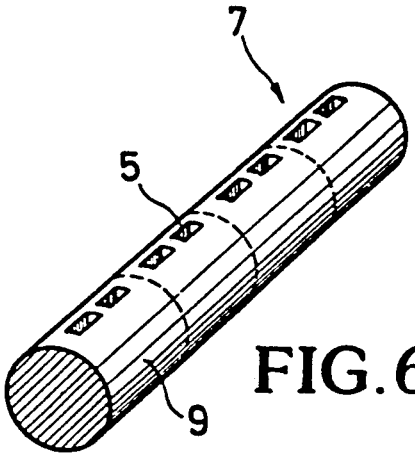
FIG.6b

SHUT-OFF AND CONTROL VALVE FOR USE IN CONTINUOUS CASTING OF A THIN STRIP OR SLAB

This application is a continuation of now abandoned application Ser. No. 310,672, filed Feb. 14, 1989.

REFERENCE TO RELATED APPLICATIONS

The present application is related to application Ser. No. 07/227,880 filed Aug. 3, 1988 and application Ser. No. 07/248,550 filed Sept. 19, 1988.

BACKGROUND OF THE INVENTION

The present invention relates to a shut-off and control valve for use in regulating the discharge of molten metal from a metallurgical vessel, particularly into a continuous casting plant for continuous casting of a sheet or strip or thin slab having a relatively wide width, and wherein such valve regulates the discharge of the molten metal through an outlet of the metallurgical vessel that is elongated. The present invention also relates to a refractory stator and to a refractory rotor employable in such shut-off and control valve.

It is know, for example, as disclosed in DE-OS 35 08 218, to regulate the flow of an elongated discharge of molten metal from a metallurgical vessel by means of chambers defined by walls, particularly for a continuous casting operation. In such arrangement, the flow of the molten metal, to be adapted to particular casting requirements, is controlled by adjusting the viscosity of the molten metal by means of the temperature of the molten metal by cooling and/or heating and is dependent on flow velocity. This arrangement particularly is advantageous for continuous casting when the flow of molten metal is to be influenced by narrow pipes or gaps, either feed or sealing segments. An induction coil driven by high frequency electric current is provided as the heating element. Such a device is relatively expensive both to construct and to operate and is not suitable to achieve rapid opening and closing of the discharge outlet.

In a continuous casting system, molten metal is guided continuously under the metallostatic pressure of the molten metal within the metallurgical vessel into an inlet or funnel of a crystallizer or plate mold of a continuous casting plant. Accordingly, the feed of the molten metal into the mold cannot be controlled independently of the metallostatic pressure within the metallurgical vessel.

In a continuous strip casting system disclosed in EP-OS 0 233 481, the bottom of the metallurgical vessel is provided with a slotted outlet, beneath which are mounted two pairs of slide valve plates that can be adjusted relative to one another and that can be moved through a defined slot between the closed and open positions to control the discharge flow of molten metal. This system is relatively expensive to build and, since the shut-off device must be mounted below the vessel, the accuracy of such device is limited at relatively large strip dimensions due to the varying thermal stresses on the slide valve plates caused by temperature gradients.

SUMMARY OF THE INVENTION

With the above discussion in mind, it is an object of the present invention to provide an improved shut-off and control device or valve of the above type, but which may be provided at a relatively low cost and that will have a high precision of discharge capable of achieving casting of very thin strips, sheets or slabs.

It is of further object of the present invention to provide such a shut-off and control valve that overcomes that above and other prior art disadvantages.

It is still a further object of the present invention to provide an assembly including operative portions of a metallurgical vessel in combination with the shut-off and control valve of the present invention.

It is an even further object of the present invention to provide a refractory stator and a refractory rotor employable in the shut-off and control valve of the present invention.

The above objects are achieved in accordance with the present invention by providing a shut-off and control valve for use in regulating the discharge of molten metal from a metallurgical vessel into a continuous casting plant for continuous casting of a strip, sheet or slab having a thin thickness dimension relative to width dimension. Particularly, the valve in accordance with the present invention includes an elongated refractory stator having therein an elongated recess defined by a cylindrical inner surface, the stator having therethrough elongated slot-like discharge channel means, the stator being mountable adjacent in elongated outlet of a metallurgical vessel. An elongated refractory rotor to be rotabable about a longitudinal axis has a cylindrical peripheral outer surface arranged symmetrically about such axis and complementary to the inner surface of the stator. The rotor has therethrough an elongated slot-like flow channel means. The rotor is fitted within the recess in the stator with the outer and inner surfaces of the rotor and stator, respectively, being symmetrically positioned about the axis and being in sealing contact with each other. Accordingly, upon rotation of the rotor about the axis relative to the stator and/or axial movement of the rotor within the recess relative to the stator, it is possible to selectively bring the flow channel means of the rotor relatively into and out of alignment with the discharge channel means of the stator. With this structure the flow channel means and the discharge channel means can be brought more or less into alignment by at least rotation of the rotor with respect to the stator, whereby the thickness of the strip readily can be controlled with high precision down to very small values. It is only necessary to achieve such function to be able to rotate the rotor relative to the stator. Despite tight sealing between the outer and inner surfaces of the rotor and stator, respectively, such rotation is possible by the application of only a small rotation force. A further advantage of the valve of the present invention is that, upon erosion or wear of the rotor and/or the stator, such structural elements can be replaced quite simply with new refractory elements.

The discharge channel means of the stator has at least one inlet and at least one outlet opening onto the inner surface and the flow channel means of the rotor has at least one inlet and at least one outlet opening onto the outer surface. The discharge channel means and the flow channel means respectively may be in the form of single slot-shaped passages extending through the stator and rotor, respectively, and each having an axial length almost equal to the axial length of the stator and rotor, respectively. Alternatively however, the discharge channel means may be in the form of plurality of slot-shaped passages extending through the stator and spaced axially along the length of the stator, and the flow channel means may be in the form of a plurality of slot-shaped passages extending through the rotor and spaced axially along the length of the rotor. Adjacent of the slot-shaped passages may be spaced by a distance greater than the axial length of the slot-shaped passages, thereby making it possible to achieve metal flow shut off by selected axial movement of the rotor relative to the stator. Such shut-off of course can also be achieved by controlled rotation of the rotor with respect to the stator.

It is possible to provide the thickness or width of the slot-like passages, as viewed in the longitudinal direction of the stator or rotor, equal to the thickness of the sheet or strip to be cast, particularly with regard to a continuous strip or sheet. In such arrangement, no other regulation is necessary to achieve casting of a continuous strip of the desired thickness. It of course is possible that the rotor may be rotated relative to the stator to regulate the discharge thickness of the cast strip or sheet. In a manner similar to the above, the axial lengths of the slot-shaped passages may be set to the precise width of the sheet or strip to be cast. However, such width dimension can be regulated by axial movement of the rotor relative to the stator.

In one embodiment of the present invention the rotor and stator each are provided as refractory cylindrical tubes. This provides the advantages of relatively low demand of refractory material and uniform temperature stress on the rotor and stator. Further, the flow of the molten metal can be balanced in the longitudinal bore of the tubular rotor. However, the outer cross-section of the stator also can be rectangular or square, and further alternatively the rotor can be in a form of a solid cylinder except for the slot-shaped passage or passages.

In accordance with a further feature of the present invention, the slot-shaped passages are of a uniform thickness dimension throughout their entire lengths relative to the direction of discharge flow. This provides a more uniform control of the flow. However, it is also possible to provide the slot-shaped passages with widened portions, particularly at the inlet sides thereof. Further, the passages normally would extend diametrally of the axis, i.e. would be uniformly rectrilinear. It is possible however in certain applications to provide the passages with inclined portions. For example, the passages may include first and second radial portions inclined to each other and intersecting at the rotary axis.

The stator and rotor can be mounted on the outside of the metallurgical vessel. Preferably however, the stator and rotor are mounted within the vessel and thus are exposed to the molten metal to insure the most uniform possible thermal stress on the refractory elements and to avoid as much as possible the risk of freezing of the molten metal. The stator and rotor may be provided as components of the refractory lining of the bottom wall of the vessel and/or of a side wall thereof. In a particularly advantageous arrangement of the present invention, at least one end of the stator and rotor extend through a side wall of the metallurgical vessel, and the rotor is rotated with respect to the stator and/or axially moved relative thereto from the exterior of such side wall of the metallurgical vessel. In a particularly advantageous arrangement, both ends of the rotor and stator extend through opposite spaced side walls of the metallurgical vessel. In this arrangement, the stator and rotor extend across the entire width of the bottom of the metallurgical vessel. In all cases, where at least one end of the stator and rotor extend through at least one side wall of the metallurgical vessel, it is particularly easy to replace the stator and rotor. When both ends of the stator and rotor extends through opposite side walls of the vessel, then it is possible to replace the rotor by axially removing the rotor from the stator by axially pushing on the rotor with a new rotor being axially pushed into the stator. This is possibly when the metallurgical vessel still contains or even is full of molten metal.

It is further possible that the rotor and/or the stator may be formed of a plurality of rotor and/or stator portions that are joined axially end-to-end.

The present invention also is directed to the novel stator and rotor that form the above shut-off and control valve of the present invention. In accordance with one feature of the present invention, the refractory material of the stator and/or the rotor may be of relatively hard and wear-resistant material, for example containing an oxide ceramic material or be formed thereof. This choice of material is particularly suitable for the stator since it is less frequently replaced than the rotor. Alternatively, the portions of the rotor and stator defining the surfaces of the slot-shaped passages may be formed of such a material, and the remaining portions of the stator and rotor may be form of a less wear-resistant ceramic material.

Further however, the refractory material of the stator and/or the rotor also can be of a relatively soft and wearable ceramic material, for example containing ceramic fibers or ceramic fibers and fibers containing carbon or graphite, or can be formed thereof. This choice of material is particularly suitable for the rotor which must be replaced more frequently than the stator. This choice of material furthermore provides good tightness and sealing between the cylindrical working surfaces of the stator and rotor. In accordance with a further feature of the present invention, it is possible to reduce the drive forces necessary to rotate and/or axially move the rotor by providing the material of the stator and/or rotor to contain, at least in the contacting cylindrical surfaces thereof carbon, graphite or a similar permanent lubricant. Thus, it is possible, for example, to provide the stator and/or the rotor to be made entirely of carbon or graphite, particularly an electrode grade graphite. It also is possible in accordance with the present invention however, to provide the stator and/or the rotor to be made of a carbon-containing refractory concrete.

BRIEF DESCRIPTION OF THE DRAWINGS

Other objects, features and advantages of the present invention will be apparent from the following description of preferred embodiments, with reference to the accompanying drawings, wherein;

FIG. 5 is a perspective view of a metallurgical vessel equipped with a shut-off and control device according to the embodiment of FIG. 2; and FIG. 6*a* and 6*b* are perspective views of a stator and rotor, respectively, employable in a shut-off and control device according to the present invention, and wherein additionally the dashed lines indicate that the stator and rotor can be formed of an assembly of a plurality of end-to-end portions.

DETAILED DESCRIPTION OF THE PRESENT INVENTION

Figure 1:
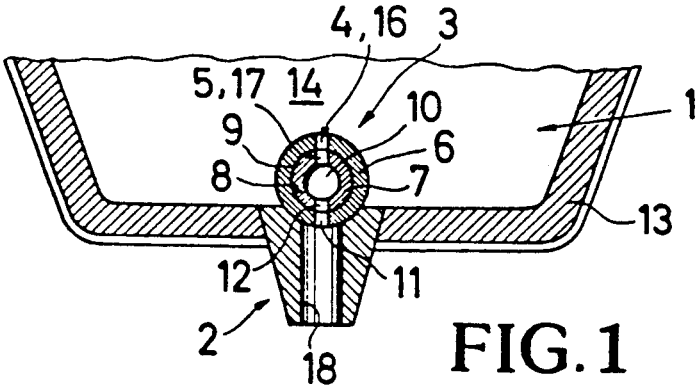
FIG. 1 is a cross-sectional view of the bottom portion of a metallurgical vessel equipped with a shut-off and control device in accordance with one embodiment of the present invention.

FIG. 1 schematically shows the bottom portion of a metallurgical vessel 1 having a refractory lining 13 interrupted by an outlet block or sleeve 2 having therein a discharge opening 18 that is intended to extend longitudinally by a substantial dimension, i.e. in a direction transverse to the plane of FIG. 1. Molten metal contained in vessel 1 is to be discharged through opening 18 into, for example, a continuous casting mold or crystallizer. This discharge is controlled by means of a shut-off and control valve 3 of the present invention, and the finished product of the continuous casting plant (not shown) is a sheet, strip or slab having a relatively thin thickness in relation to width. Alternatively, as would be understood by one skilled in the art, the discharged molten metal might be guided onto a moving surface, for example formed by a drum.

The shut-off and control valve 3 shown in FIG. 1 includes an elongated refractory stator 6 in the form of a cylindrical tube having therethrough an elongated recess defined by a cylindrical inner surface 8. Intersecting such recess is an elongated discharge channel 4 including an inlet 16 and an outlet 17. The recess and the discharge channel 4 extend axially of the rotor, i.e. in a direction transverse to the plane of FIG. 1, almost throughout the entire length of the stator (see FIG. 5). The valve 3 further includes an elongated refractory rotor 7 in the form of a tube and having a cylindrical peripheral outer surface 9 arranged symmetrically about a longitudinal rotational axis 10 of rotor 7. Rotor 7 further has therethrough an elongated slot-like flow channel 5 including an inlet 17 and an outlet 12. Rotor 7 is fitted within the recess in stator 6 with outer surface 9 in sealing contact with inner surface 8 and with both surfaces 8 and 9 positioned symmetrically about axis 10. The discharge channel 4 and the flow channel 5 extend diametrally, and in the open position illustrated in FIG. 1 vertically. By rotation of rotor 7 relative to stator 6 is possible to move the valve between the illustrated open position and a closed position. With the valve in the open position illustrated, there will be discharged through the discharge opening 18 an elongated, i.e. wide, sheet or strip of a relatively thin thickness. Movement of the rotor to less than the fully opened position illustrated will regulate the thickness of the discharged sheet or strip. The rotor 7 also is axially movable relative to stator 6, and this may be employed to regulate the width of the discharged strip or sheet.

Figure 2:
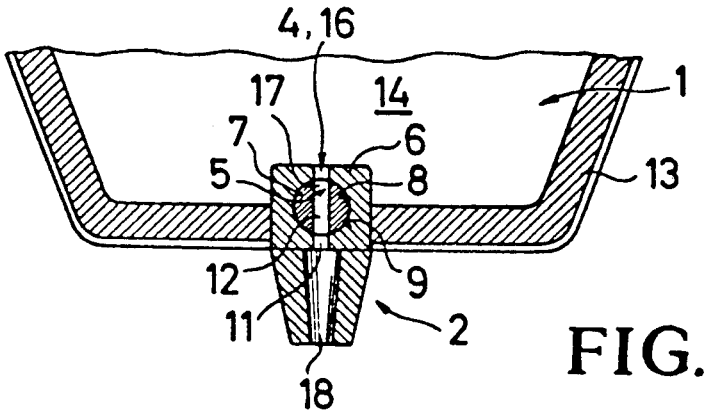
FIG. 2 is a view similar to FIG. 1 but of another embodiment of the shut-off and control device of the present invention.

The embodiment of FIG. 2 is similar to the embodiment of FIG. 1, but in FIG. 2 the outer configuration of the stator 6 is rectangular in cross section and such stator is fitted within the refractory lining 13 of the bottom wall of the metallurgical vessel. Also, the rotor 7 is a solid cylinder except for the flow channel 5. Still further, the outlet block 2 is mounted from below on the bottom of the vessel. In this embodiment, as well as in the other embodiments, the outlet block 2 and the stator 6 can be formed as one integral member.

Figure 3:
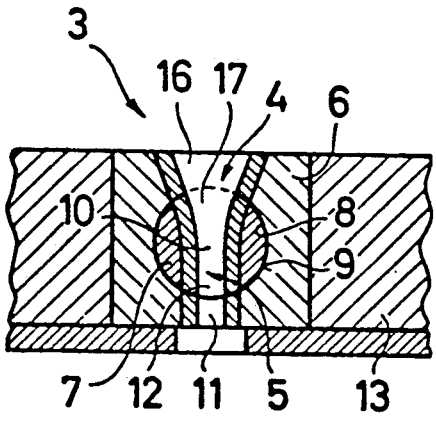
FIG. 3 is a view similar to FIGS. 1 and 2, but fragmentary and at an enlarge scale, of still another embodiment of the shut-off and control device of the present invention.

The embodiment of FIG. 3 is similar to the embodiment of FIG. 2. However, in the embodiment of FIG. 3 the rectangular stator 6 is completely integrated into the bottom wall lining 13. FIG. 3 illustrates a further feature that may be employed in the present invention wherein the inlet ends 16, 17 of the discharge and flow channels 4, 5 are conically expanded upwardly. FIG. 3 illustrates a yet further feature that may be incorporated into the present invention wherein the walls defining the discharge channel 4 and the flow channel 5 are formed of a different refractory material than the remainder of the stator and rotor. Particularly, whereas the majority of the stator and rotor may be made of a relatively less wear resistant and therefore less expensive refractory material, the surfaces contacting the metal may be made of a more expensive, high-grade and wear resistant refractory material.

Figure 4:
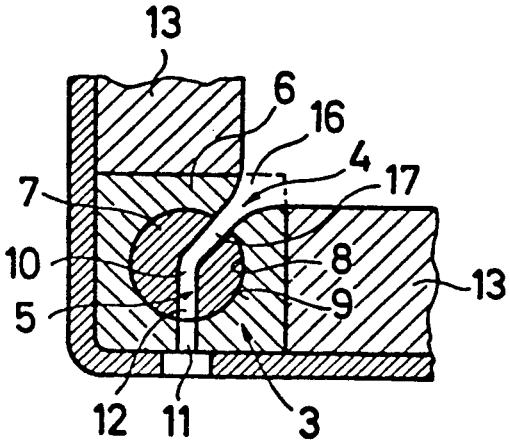
FIG. 4 is a view similar to FIG. 3 but of yet another embodiment of the shut-off and control device of the present invention.

In the embodiment of FIG. 4, the shut-off and control valve of the present invention is located within the refractory lining 13 of the bottom wall and one side wall of the metallurgical vessel, i.e. in an area of intersection or juncture between such linings. In this case, the discharge channel 4 and the flow channel 5 each include two radial portions intersecting at the axis 10 such that the first or inlet portions 16, 17 are inclined to the vertical, whereas outlet portions 12, 11 extend vertically. It also would be possible however to have the outlet portions extend generally horizontally, such that such outlet portions would project through the side wall of the metallurgical vessel.

FIG. 5 illustrates a metallurgical vessel equipped with a valve according to the embodiment of FIG. 2, and specifically showing the opposite ends of of the stator 6 and rotor 7 extending through opposite side walls of the metallurgical vessel. Thus, the rotor 7 can be rotated from the outside of the vessel and also can be moved axially relative to the stator. In this embodiment it also would be possible to replace the stator 6 and rotor 7 through the side walls 14, 15. FIG. 5 also illustrates the feature that the discharge channel 4, as well as the not illustrated flow channel 5 can extend across almost the entire length of the vessel, with the exception of small end regions. This makes it possible to continually cast strips to substantial width dimensions.

FIGS. 6*a* and 6*b* respectively illustrate stator 6 and rotor 7 and showing a further feature of a present invention. Thus, the stator 6 may have therethrough, rather than a single elongated slot-shaped passage 4, a plurality of slot-shaped passages 4 spaced axially along the length of stator 6. Similarly, rotor 7 may have therethrough a plurality of slot-shaped passages 5 spaced axially along the length of rotor 7. When the spacings between the adjacent slot-shaped passages 4, 5 are greater than the axial lengths of such slot-shaped passages, then shut-off of the valve can be achieved by axial movement of the rotor relative to the stator. It of course is possible also to achieve shut-off and sheet thickness regulation by rotation of the rotor relative to the stator. FIGS. 6*a* and 6*b* illustrate a yet further feature of the present invention wherein the stator 6 and/or the rotor 7 may be formed, rather than as a single integral elongated member, as a plurality of portions joined axially end-to-end. Such portions would have mating elements at facing end surfaces, and the multi-element rotor 7 can be driven as a single unit relative to the stator axially and/or rotatably. The dashed lines in FIGS. 6*a* and 6*b* illustrate this feature of the present invention.

Although the present invention has been described and illustrated with respect to preferred features thereof, it would be understood by those skilled in the art that various modifications and changes may be made to the specifically described and illustrated features without departing from the scope of the present invention.

I claim:

1. A shut-off and control valve for use in regulating the discharge of molten metal from a metallurgical vessel into a continuous casting plant for continuous casting of a trip or a thin slab having a relatively wide width and a relatively thin thickness, said valve comprising:

an elongated refractory stator having therein an elongated recess defined by a cylindrical inner surface concentric about a longitudinal axis of said stator, said stator having therethrough discharge channel means elongated in a direction parallel to said longitudinal axis said stator being mountable adjacent an elongated outlet of a metallurgical vessel;

an elongated refractory rotor to be rotatable about a longitudinal axis of said rotor and having a cylindrical peripheral outer surface arranged symmetrically about said longitudinal axis of said rotor and complementary to said inner surface of said stator, said rotor having therethrough flow channel means elongated in a direction parallel to said longitudinal axis of said rotor;

said rotor being fitted within said recess in said stator with said outer and inner surfaces of said rotor and stator, respectively, being symmetrically positioned about said longitudinal axes and being in sealing contact with each other, such that at least one of rotation of said rotor about said axes relative to said stator and axial movement of said rotor within said recess relative to said stator selectively bring said flow channel means of said rotor relatively into and out of alignment with said discharge channel means of said stator; and said discharge channel means and said flow channel means having lengths in directions parallel to said axes to approximately define the width of a strip or slab to be cast.

2. A valve as claimed in claim 1, wherein said discharge channel means of said stator has at least one inlet and at least one outlet opening onto said inner surface, and said flow channel means of said rotor has at least one inlet and at least one outlet opening onto said outer surface.

3. A valve as claimed in claim 1, wherein said discharge channel means comprises a single slot-shaped passage extending through said stator and having an axial length almost equal to the axial length of said stator.

4. A valve as claimed in claim 1, wherein said discharge channel means comprise a plurality of slot-shaped passages extending through said stator and spaced axially along the length of said stator.

5. A valve as claimed in claim 4, wherein adjacent of said slot-shaped passages are spaced by a distance greater than the axial length of said slot-shaped passages.

6. A valve as claimed in claim 1, wherein said stator comprises a plurality of stator portions joined axially end-to-end.

7. A valve as claimed in claim 1, wherein the width of said discharge channel means, as viewed axially of said stator, is uniform.

8. A valve as claimed in claim 1, wherein said discharge channel means includes a widened inlet portion.

9. A valve as claimed in claim 1, wherein said discharge channel means extends diametrally of said axis.

10. A valve as claimed in claim 1, wherein said discharge channel means includes first and second radial portions inclined to each other and intersecting at said axis.

11. A valve as claimed in claim 1, wherein said stator comprises a cylindrical tube.

12. A valve as claimed in claim 1, wherein said stator has a substantially rectangular exterior configuration.

13. A valve as claimed in claim 1, wherein said flow channel means comprises a single slot-shaped passage extending through said rotor and having an axial length almost equal to the axial length of said rotor.

14. A valve as claimed in claim 1, wherein said flow channel means comprise a plurality of slot-shaped passages extending through said rotor and spaced axially along the length of said rotor.

15. A valve as claimed in claim 14, wherein adjacent of said slot-shaped passages are spaced by a distance greater than the axial length of said slot-shaped passages.

16. A valve as claimed in claim 1, wherein said rotor comprises a plurality of rotor portions joined axially end-to-end.

17. A valve as claimed in claim 1, wherein the width of said flow channel means, as viewed axially of said rotor, is uniform.

18. A valve as claimed in claim 1, wherein said flow channel means includes a widened inlet portion.

19. A valve as claimed in claim 1, wherein said flow channel means extends diametrally of said axis.

20. A valve as claimed in claim 1, wherein said flow channel means includes first and second radial portions inclined to each other and intersecting at said axis.

21. A valve as claimed in claim 1, wherein said rotor comprises a cylindrical tube.

22. A valve as claimed in claim 1, wherein said rotor comprises a solid cylindrical body except for said flow channel means.

23. An assembly comprising a metallurgical vessel including a bottom wall having a refractory lining, at least one side wall having a refractory lining, and a shut-off and control valve mounted at least partially within at least one of said refractory linings for regulating the discharge of molten meal from said metallurgical vessel into a continuous casting plant for continuous casting of a strip or a thin slab having a relatively wide width and a relatively thin thickness, said shut-off and control device comprising:

an elongated refractory stator having therein an elongated recess defined by a cylindrical inner surface concentric about a longitudinal axis of said stator, said stator having therethrough discharge channel means elongated in a direction parallel to said longitudinal axis, said stator being mounted adjacent an elongated outlet of aid metallurgical vessel;

an elongated refractory rotor rotatable about a longitudinal axis of said rotor and having a cylindrical peripheral outer surface arranged symmetrically about said longitudinal axis of said rotor and complementary to said inner surface of said stator, said rotor having therethrough flow channel means elongated in a direction parallel to said longitudinal axis of said rotor;

said rotor being fitted within said recess in said stator with said outer and inner surfaces of said rotor and stator, respectively, being symmetrically positioned about said longitudinal axes and being in sealing contact with each other, such that at least one of rotation of said rotor about said axes relative to said stator and axial movement of said rotor within said recess relative to said stator selectively bring said flow channel means of said rotor relatively into and out of alignment with said discharge channel means of said stator; and said discharge channel means and said flow channel means having lengths in directions parallel to said axes to approximately define the width of a strip or slab to be cast.

24. An assembly as claimed in claim 23, wherein at least a portion of said valve extends above said refractory lining of said bottom wall.

25. An assembly as claimed in claim 23, further comprising an elongated refractory outlet block leading from said bottom wall of said vessel, and said valve is mounted on an inlet end of said outlet clock.

26. An assembly as claimed in claim 23, wherein said valve is mounted in said refractory lining of said bottom wall.

27. An assembly as claimed in claim 23 wherein said valve is mounted in and forms part of an area of juncture of said refractory linings of said bottom and side walls.

28. An assembly as claimed in claim 23, wherein said valve is longitudinally insertable through and withdrawable from said side wall, and said rotor has an end that is rotatable from the exterior of said side wall.

29. An assembly as claimed in claim 23, comprising two spaced said side walls, and wherein said valve has opposite ends extending through respective said side walls.

30. An assembly as claimed in claim 29, wherein said rotor is axially removable from said stator by being axially pushed therefrom by a new rotor being axially pushed into said stator, even when said vessel contains molten metal.

* * * * *